United States Patent [19]

Fuller

[11] 4,333,208

[45] Jun. 8, 1982

[54] GUTTER GUARD CLIP AND METHOD OF MANUFACTURE

[76] Inventor: Ernest H. Fuller, 3225 E. Riverside Dr., Ft. Myers, Fla. 33901

[21] Appl. No.: 55,595

[22] Filed: Jul. 9, 1979

[51] Int. Cl.[3] ..... A44B 21/00; B23P 11/00

[52] U.S. Cl. ..... 24/1; 24/343; 24/373; 24/259R; 29/513; 210/474

[58] Field of Search ..... 24/1, 81 R, 81 B, 259 R; 210/474; 29/513

[56] References Cited

U.S. PATENT DOCUMENTS

| | | | |
|---|---|---|---|
| 2,168,911 | 8/1939 | Meyer | 24/81 B |
| 2,267,379 | 12/1941 | Tinnerman | 24/259 R |
| 2,625,723 | 1/1953 | Bassett | 29/513 |
| 2,636,458 | 4/1953 | Harris | 24/81 B |
| 2,717,561 | 9/1955 | Bearden | 210/474 |
| 2,805,880 | 9/1957 | Brozek et al. | 29/513 |
| 2,810,173 | 10/1957 | Bearden | 24/81 B |
| 2,810,177 | 10/1957 | Hutchison, Jr. | 24/259 R |
| 2,894,303 | 7/1959 | Armstrong et al. | 24/81 B |
| 2,948,083 | 8/1960 | Steele | 210/474 |
| 2,997,763 | 8/1961 | Serfass | 24/81 B |
| 3,053,393 | 9/1962 | McLean | 210/474 |
| 3,144,733 | 8/1964 | Balinski | 24/81 B |
| 3,163,385 | 12/1964 | Lazan, Jr. | 24/81 B |
| 3,208,119 | 9/1965 | Seckerson | 24/259 R |
| 3,297,285 | 1/1967 | Simmons | 24/81 B |
| 3,348,272 | 10/1967 | Germani | 24/259 R |
| 3,351,206 | 11/1967 | Wennerstrom | 210/474 |
| 3,367,070 | 2/1968 | Mitchell | 210/474 |
| 3,420,378 | 1/1969 | Turner | 210/474 |
| 4,036,761 | 7/1977 | Rankin | 24/81 R |

FOREIGN PATENT DOCUMENTS

| | | | |
|---|---|---|---|
| 1015998 | 1/1966 | United Kingdom | 24/81 R |

*Primary Examiner*—Victor N. Sakran

[57] ABSTRACT

An improved gutter guard clip comprises a strip having at one end at least one tab or tine which can be bent through and under an opening of a screen member of a gutter and the opposite end can be bent over the outer flange of the gutter to hold the screen securely in place on the gutter. The strip can be made of a metal or a plastic material which can be readily bent beyond its elastic limits to retain substantially its bent shape. Modifications of the clip can be readily made by providing a hole in the gutter - overlapping portion through which a nail, screw or rivet can be inserted during the initial installation of the gutter. A method for making the gutter guard clip is also provided.

7 Claims, 7 Drawing Figures

GUTTER GUARD CLIP AND METHOD OF MANUFACTURE

BACKGROUND OF THE INVENTION

Several devices for holding gutter guards in place have been proposed in the past. All suffer shortcomings in that some require several steps in their manufacture; others require either a large amount of material or a material such as a spring steel for their construction, and others provide for attachment a screen on the roof side of a gutter and thereby impede the flow of water and can result in entrapment of debris, which further prevents flow of water into the gutter.

One prior art structure, made of a spring metal is described in U.S. Pat. No. 2,636,458. It is L shaped and has a series of tongues intended to hold a gutter screen in place. One of the tongues is placed over the edge of the screen and another engages the inner wall of the gutter.

In U.S. Pat. No. 2,717,561, there is described a gutter screen bracket with separate supports for the front and back inner edges of the gutter. Each support extends along the entire depth of the gutter and is adjustable as to height. A clip along one upper edge of the bracket holds one of the supports in place.

U.S. Pat. No. 2,810,173 discloses a clip having spaced clamping fingers for inserting a screen between them. Each finger has a flange for facilitating the insertion of the screen.

The clamps shown in U.S. Pat. No. 3,367,070 rely on spring tension to hold a screen on a drain. In each instance the clamp extends across the trough and onto the roof edge.

U.S. Pat. No. 3,420,378 discloses a hinged screen clamp, with provision for attaching the clamp to the interior lip of the outer edge of a gutter. In one modification the screen is inserted between a pair of brackets and in another design the upper bracket has a pair of tabs for securing the screen to the clamp.

The clamp of U.S. Pat. No. 4,036,761 has two rotational nodes. The screen fits into one of the nodes and the second is situated on the outer edge of the gutter flange. This provides the ability to rotate the screen up to about 170° for cleaning.

DRAWING

DESCRIPTION OF THE INVENTION

The invention comprises a simple clip for fastening a screen or guard to a roof gutter and to a method for making the clip.

An object of the invention is the provision of a simple, easily installed gutter guard fastener or clip.

Another object is the provision of a gutter guard or clip which requires only simple tools for installation.

A further object is the provision of a gutter guard clip having a tine or tab adjacent one end which can be bent under the gutter guard and gutter lip of the gutter flange and a body portion that can be folded around the outer flange of the gutter.

Still another object is the provision of a gutter guard or clip in which the body portion has an opening for insertion of a nail or screw to hold the clip in rigid position.

Another object is the provision of a method for making a gutter guard or clip by a simple stamping operation.

Figure 1:
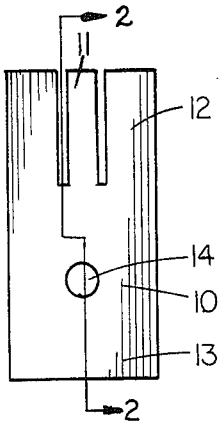
FIG. 1 is a front view of one modification of the clip of this invention.

Referring to the drawing, FIG. 1 shows a clip 10, having a tab or tine 11, adjacent to a pair of ribs 12, 12 on a body section 13, and an optional hole 14.

Figure 2:
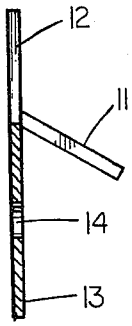
FIG. 2 shows a vertical section of the clip of FIG. 1 along lines 2—2 with a tab or tine bent forward.

FIG. 2 is a vertical section along lines 2, 2 of FIG. 1, with the tab 11 bent outwardly prior to insertion of the clip through the openings of a gutter guard or screen.

Figure 3:
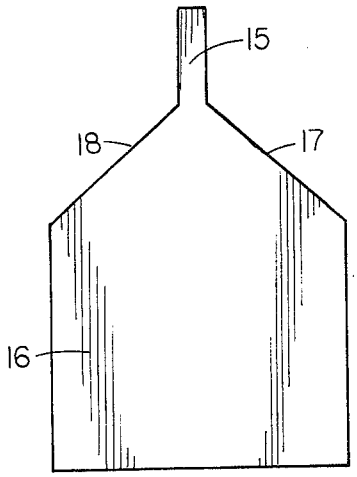
FIG. 3 is a front view of another modification of the invention.

FIG. 3 shows another modification of the invention. A tab or tine 15 is formed at one end of the article. This tab 15 is connected to a body section 16 by a pair of tapering sides 17, 18. It is apparent that this modification and all others hereafter described can have a hole similar to numeral 14 of FIG. 1 for attaching the clip to a gutter.

Figure 4:
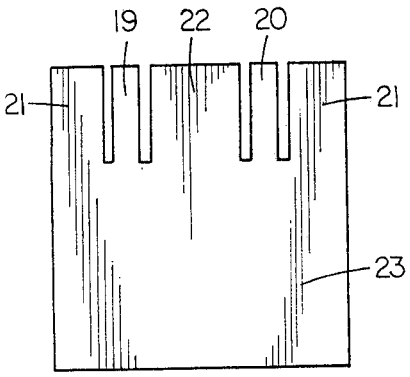
FIG. 4 shows a front view of a clip having a plurality of segments such as shown in FIG. 1.

FIG. 4 is another modification which has a plurality of tabs or tines 19, 20 end ribs 21, 21 and a bridging section 22 and body 23. This in effect is a multiple structure of that shown in FIG. 1.

Figure 5:
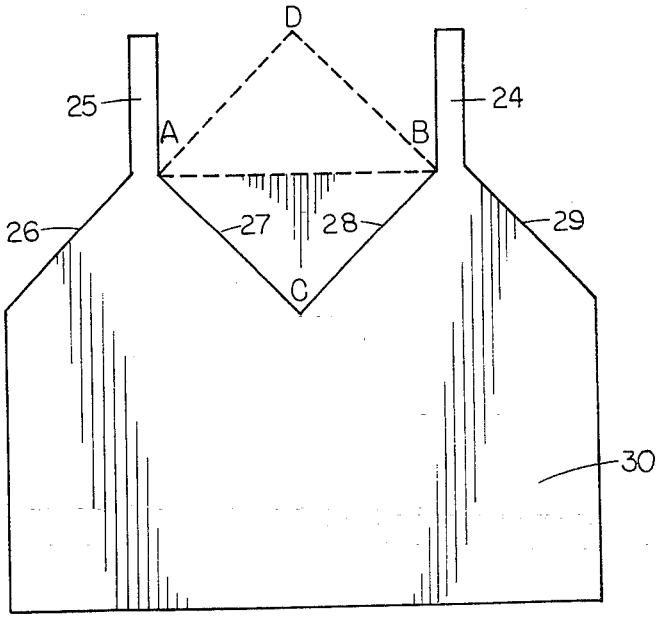
FIG. 5 shows a front view of a clip having a plurality of segments such as shown in FIG. 4.

Similarly, the structure of FIG. 5 is a multiple of that shown in FIG. 3. The modification of FIG. 5 has tabs or tines 24, 25 tapered sections 26, 27, 28 and 29 connecting to the main body portion 30.

It is to be understood that the FIG. 5 structure can be modified by leaving a section defined by the triangle A, B, C or a section defined by the quadrangle A, B, C, D on the unit.

Figure 6:
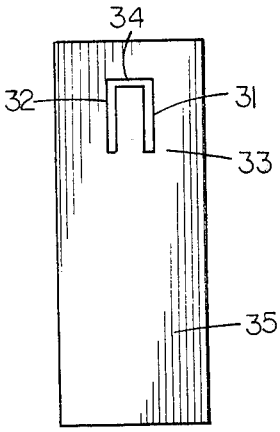
FIG. 6 is a front view of a third modification of the clip of this invention.

The modification in FIG. 6 has a vertical tab on tine 31 adjacent to ribs 32, 33 which are integral with a bridging section 34 located above the tab and bridge sections. The body portion 35 completes this structure.

The material of construction can be any malleable metal or plastic which can be deformed beyond its elastic limit without fracturing. Representative materials include, but are not limited to, ferrous metals including plated steels, aluminum, magnesium, copper, zinc, lead, cobalt, tin, nickel, and alloys such as steel, brass, bronze, monel, and the several stainless steels. The preferred metals are steel or plastic coated or enameled steel and aluminum.

Plastics can be typical fiber, or fiberglass, reinforced polyesters, polyurethanes or polyamides, but are not limited to these plastics. Any plastic that can be deformed beyond its elastic limits without fracturing can be used.

Figure 7:
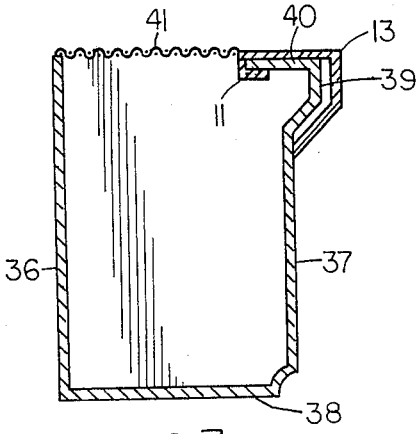
FIG. 7 shows a cross section of a gutter and screen having a clip holding the screen in place.

Referring to FIG. 7, this shows how the clip is employed on a typical gutter guard. A drain gutter placed below an eave of a building has a wall 36 nearest the building, and a wall 37 remote from the building, and a bottom 38. As is well known, the gutter 36,37,38 is attached to the building by means of brackets (not shown). The remote wall 37 terminates at its top with a flange, 39, having an inwardly projecting lip 40. A guard or screen 41 extends across the opening between wall 36 and over the lip 40. For purposes of simplicity, the attachment of the clip of FIG. 1 is described here in detail, although it shall be evident that all the variations of this invention can be employed in a similar manner. The tab 11 is bent in the manner shown in FIG. 2 and positioned below an opening of the gutter screen or guard. The body of the clip is laid flat against the screen and the tab 11 is bend under the lip 40. The body 13 of the clip is then bent around the flange 39. Ribs 12, 12 rest upon the surface of the screen or guard. The bending of the tab 11 can be readily effected with a pair of pliers having a nose which will fit between the openings of the screen, or by use of a screw driver or metal rod. The body portion of the clip can be bent around the flange by hand or with a pair of pliers.

It is to be understood that the tab or tine of each of the variations of this invention can be bent and inserted into the opening of the guard or screen and then bent under the flange lip of the gutter and the body portion can be bent over the flange by hand or by use of pliers. If the outer gutter wall is straight, then the clip can be more securely attached by use of a nail or a sheet metal screw through an opening such as that shown by 14 FIG. 1.

Each of the clips of this invention can be made in a single step by stamping with an appropriate die in a punch press. This can be effected by feeding blanks individually into a punch press, between proper aligning guides and stamping or, if desired, the punch press can be fed sequentially from a roll of proper width, and after each stamping operation, an additional length of material is fed to the press. These stamping operations are well known in the sheet metal stamping industry and thus are not shown here in detail for purposes of brevity.

The tab can range from about $\frac{1}{8}$ to about $\frac{1}{4}$ inch in width and from about $\frac{1}{2}$ to about 1 inch in length. The overall length of the clip can range from about 2 to about 4 inches. The thickness of the clip can range from about 0.025 to about 0.25 inch, depending primarily on the softness or malleability of the material of construction. For sheet steel or aluminums, the preferred thickness ranges from about 0.05 to about 0.15 inch.

The above description is intended to be illustrative and not as a limitation on the invention claimed herein.

I claim:

1. A clip useful for securing a guard to a gutter comprising at least one tab of from about $\frac{1}{8}$ to about $\frac{1}{4}$ inch in width and from about $\frac{1}{2}$ to about 1 inch in length adjacent one end, said tab being of sufficient length to be capable of being positioned below an opening of a gutter screen and bent under the lip of the gutter flange means adjacent said tab for supporting a portion of the clip on the surface of said guard, and a body member capable of being bent around the outside of said flange, the said clip being constructed of a malleable material which can be bent readily beyond its elastic limit without fracturing, said material having a thickness of from about 0.025 to about 0.25 inch and said clip having an overall length of from about 2 to about 4 inches.

2. The clip of claim 1 made of sheet metal.

3. The clip of claim 1 made of aluminum having a thickness of from about 0.05 to about 0.15 inch.

4. The clip of claim 1 having a single tab at one periphery.

5. The clip of claim 4 in which the tab has a pair of adjacent supporting ribs.

6. The clip of claim 4 in which a terminal tab is connected to the body section by a pair of tapering sides.

7. The clip of claim 4 having a cross member at one end connecting supporting ribs adjacent to and in front of the tab.

* * * * *